US008757530B2

(12) United States Patent
Sutti et al.

(10) Patent No.: US 8,757,530 B2
(45) Date of Patent: Jun. 24, 2014

(54) PITMAN OF A JAW CRUSHER, JAW CRUSHER, CRUSHING PLANT AND CRUSHING METHOD

(75) Inventors: Risto Sutti, Tampere (FI); Jari Jonkka, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 378 days.

(21) Appl. No.: 13/212,342

(22) Filed: Aug. 18, 2011

(65) Prior Publication Data

US 2013/0043335 A1 Feb. 21, 2013

(51) Int. Cl.
*B02C 1/08* (2006.01)
*B02C 17/14* (2006.01)

(52) U.S. Cl.
USPC ..... 241/264; 241/266

(58) Field of Classification Search
USPC ..... 241/101.73, 264–269, 300
See application file for complete search history.

(56) References Cited

U.S. PATENT DOCUMENTS 2,341,105 A * 2/1944 Kueneman et al. ..... 241/266
2,449,746 A * 9/1948 Kinkel ..... 241/269
2,453,596 A * 11/1948 Roubal ..... 241/300
2,843,331 A * 7/1958 Reeves ..... 241/198.1
2,851,225 A * 9/1958 McMahan ..... 241/300
3,129,899 A * 4/1964 Ratkowski ..... 241/300.1
3,153,512 A * 10/1964 Polzin ..... 241/300
6,641,068 B2 * 11/2003 Ostergaard ..... 241/268
6,957,786 B2 * 10/2005 Bratton et al. ..... 241/267
2010/0044486 A1 * 2/2010 Holmes ..... 241/264

FOREIGN PATENT DOCUMENTS

EP 1 008 387 A1 6/2000
EP 1 049 539 B1 5/2007

OTHER PUBLICATIONS

International Search Report dated Jun. 14, 2012.

* cited by examiner

*Primary Examiner* — Faye Francis
(74) *Attorney, Agent, or Firm* — Andrus Intellectual Property Law, LLP

(57) ABSTRACT

A pitman of a jaw crusher has an upper part, which includes an upper supporting point for supporting the pitman in the body of the jaw crusher, and a lower part having a lower supporting point for supporting the pitman in the body of the jaw crusher through a toggle plate. The lower part of the pitman includes sidewalls and honeycomb structure open to the crushing direction, which structure has one or more cross-sectional supports reaching from the first sidewall of the pitman to the second sidewall.

17 Claims, 3 Drawing Sheets

PITMAN OF A JAW CRUSHER, JAW CRUSHER, CRUSHING PLANT AND CRUSHING METHOD

FIELD OF THE INVENTION

Figure 1:
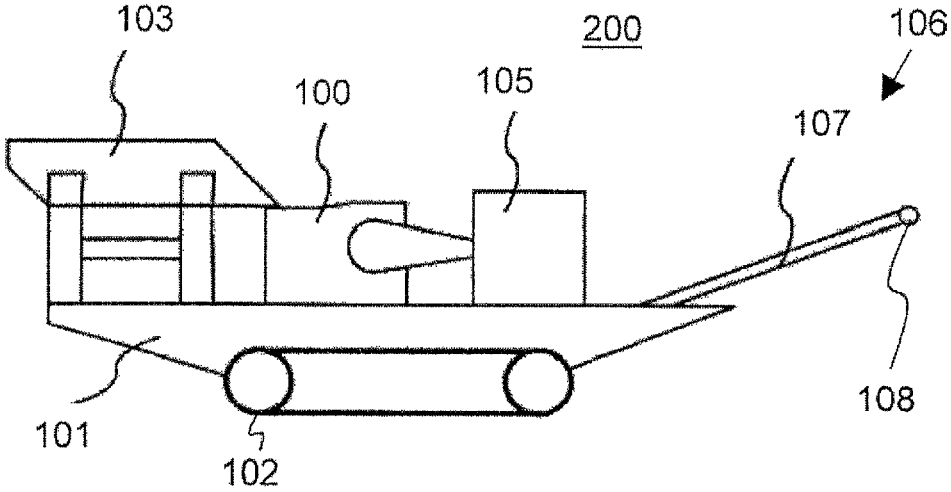

The invention relates to a pitman of a jaw crusher, a jaw crusher and a crushing plant and a crushing method, which are suitable for crushing mineral material.

BACKGROUND OF THE INVENTION

The function of the jaw crusher is based on the force pressing stone, the jaw moving in respect of an eccentric shaft moves back and forth regarding the fixed jaw. Movable jaws i.e. pitmans of the jaw crushers have been produced in various different ways. A casted pitman is enclosed i.e. closed in its cross-sectional profile. In the patent publication EP1049539B1, there is presented a jaw crusher with a pitman with closed cross-sectional profile.

Manufacturing a pitman according to a closed profile requires several different work phases. When casting, cores are needed for manufacturing closed profile parts. The moving of cores during casting has lead to differences in wall thicknesses of the webs, because of which the wall thickness of the castings have to be oversized, which adds to the cost and dynamic forces. It is difficult to check and correct casting and quality errors in an enclosed pitman. In an enclosed structured pitman, various exhaust openings are needed for removing the sand in the core. Sand removal through exhaust openings after the casting is laborious and time consuming.

In known solutions, for reaching sufficient strength plenty of material is required in the lower part of the pitman. This increases the mass of the pitman, which increases dynamic forces.

When the material to be crushed is located one-sidedly in the crushing chamber it is a question of one-sided crushing. In that case, momentary transformations are developed in the pitman due to the one-sided strain, which transformations distort the pitman. The transformations increase power requirement and reduce crushing capacity. Additionally, the material in the pitman is exposed to fatigue, especially in the area of the supporting point of the toggle plate.

In some cases, the side plates of the body of the jaw crusher are joined with each other by an intermediate rod in the part between the ends of the body. A typical location for the intermediate rod is in the location of the pitman. A horizontal hole for the intermediate rod leading from the first side of the body to the second side of the body is formed in the pitman because of this. In the casting process, a core is placed in the hole for the intermediate rod, the sand of which core has to be removed after casting. In cooling down, thermal stresses result in the hole for the intermediate rod that do not necessarily entirely disappear in the thermal treatment. It is known that the hole for the intermediate rod is non-machined and the hole with cast surface is sensitive to crack formation. The area of the hole for the intermediate rod is a critical spot because of the peak stresses caused by the crushing force.

SUMMARY

According to a first aspect of the invention, a pitman of a jaw crusher is implemented, the pitman comprising an upper part which comprises an upper supporting point for supporting the pitman in the body of the jaw crusher, and a lower part comprising a lower supporting point for supporting the pitman in the body of the jaw crusher through a toggle plate, and the lower part of the pitman comprises sidewalls and a honeycomb structure open to the crushing direction, which structure comprises one or more cross-sectional supports reaching from the first sidewall to the second sidewall.

Preferably, the lower supporting point of the pitman is arranged in the location of the cross-sectional support of the honeycomb structure. Preferably, the lower supporting point of the pitman is arranged in the location of the cross-sectional support of the honeycomb structure in the vertical direction of the pitman.

Preferably, the sidewalls of the pitman form the sidewalls of the honeycomb structure; and the honeycomb structure comprises one or more vertical supports intersecting with the cross-sectional supports/supports for dividing the space between the sidewalls of the pitman vertically in parts.

Preferably, the honeycomb structure comprises a continuous back wall area to which the sidewalls, vertical supports and cross-sectional supports are attached from their back part.

Preferably, the back wall area comprises a lower back wall area and an upper back wall area which join in the location of the cross-sectional support and the back wall areas are arranged parallel such that the force directed in the pitman by means of a toggle plate in a crushing event is substantially parallel with the direction of the back wall areas.

Preferably, the front surface of the lower part comprises front edges of the sidewalls, vertical supports and cross-sectional supports for receiving a wear part.

Preferably, a centering mechanism of the wear part is attached in the intersections of the vertical supports and cross-sectional supports in the front surface of the lower part.

According to a second aspect of the invention, a jaw crusher is implemented for crushing mineral material which jaw crusher comprises a pitman of a jaw crusher according to an embodiment of the invention.

According to a third aspect of the invention, a crushing plant is implemented comprising a pitman of a jaw crusher according to an embodiment of the invention or a jaw crusher according to an embodiment of the invention.

According to a fourth aspect of the invention, a method is implemented for increasing crushing capacity of mineral material in a jaw crusher or in a crushing plant, which jaw crusher or crushing plant comprises a crushing chamber and a pitman arranged in the crushing chamber, which pitman comprises an upper part comprising an upper supporting point for supporting the pitman in the body of the jaw crusher, and a lower part comprising a lower supporting point for supporting the pitman in the body of the jaw crusher through a toggle plate, and in the method, in a crushing event the pitman is moved, the lower part of which pitman comprises sidewalls and a honeycomb structure open to the crushing direction, which structure comprises one or more cross-sectional supports reaching from the first sidewall to the second sidewall for dividing the space between the sidewalls horizontally in parts.

Preferably, the toggle plate comprised by the jaw crusher is supported in the lower supporting point which is arranged in the location of the cross-sectional support of the honeycomb structure.

Preferably, the toggle force directed at the pitman through the toggle plate is conveyed into the crushing direction through the cross beam. Preferably, the toggle force directed at the pitman through the toggle plate is conveyed in the crushing process through the lower back wall area of the lower part.

According to a fifth aspect of the invention, there is implemented a method according to which the lower part of the pitman of the jaw crusher is manufactured by casting without a core. Preferably, in the core-free manufacturing method of the pitman of the lower part, the hole for the intermediate rod is manufactured by machining. Preferably, the hole for the intermediate rod is machined in a discretionary location for controlling the strength and the residual tensions. The location of the hole for the intermediate rod may be chosen more freely than in a known hole manufacturing method by casting.

According to some embodiments, the upper part of the pitman comprises a backwards open cross-sectional profile above the honeycomb structure of the lower part. Preferably, the backwards open cross-sectional profile comprises vertical webs between the sidewalls in addition to the sidewalls of the pitman.

According to some embodiments, the upper part of the pitman comprises above the honeycomb structure of the lower part a honeycomb structure like the honeycomb structure of the lower part which is open from the front surface of the upper part of the pitman.

A cross-sectional support arranged in the honeycomb structure reduces or removes bending of the pitman and the wear part compared with a known pitman, which has poorer horizontal rigidity. The cross-sectional supports eliminate bending and distortion horizontally. The cross-sectional support may reduce support span which is in the pitman in the back of the wear part. The pressing work in a crushing event is better focused in breaking the stone and not in the transformation (elasticity) of the pitman. Thus the stone may be crushed with smaller stroke count and smaller stroke length. The capacity of the crusher and the crushing plant may be increased because the mineral material is crushed and does not stay waiting for a new stroke. Crushing work done by a smaller stroke also affects other components of the crusher which may be lightened if needed. If needed, the mass of the flywheel and the counterweight of the crusher may be reduced. The power source may be smaller in power, as well. The amount of the energy engaged in the flywheel may be reduced. The environment is less burdened because of savings in material and energy. If a known amount of material is used the structure may be made more durable and more rigid.

The quality of manufacturing the pitman may be improved. There are less work phases and the manufacturing may be speeded up. When casting no cores (web) are needed which cause differences in wall thickness and additional costs. In manufacturing the pitman less material is needed which reduces the mass of the pitman. Weight may also be reduced by machining the edges of the webs because the machining surface has significantly higher fatigue strength than the casting surface. The casting is more easily done. In the manufacturing, a considerably better end quality may be achieved and the wall thicknesses are easily checked and the weight of the pitman optimized. The openness makes it easy to check and fix casting defects. Casting defects may be removed by grinding from the web edges which are critical in tension. Sand cleaning holes are not needed and the sand removal phase is left out.

Holes formed in the structure because of casting may be avoided by an open structure of the pitman. Thus strength-weakening stress peaks caused by crushing forces may be diminished in the structure. The hole for the intermediate rod may be made entirely by machining, in which case the fatigue strength of the structure is better than in case of the non-machined surface generated after casting. In that case one may get rid of the residual tensions of the hole, as well. Additionally, the location of the hole for the intermediate rod may be better chosen when in a whole less residual tension remains in the pitman than in the known pitman.

In the solution of the pitman, strength advantage is achieved when the force of the toggle plate is received on a nearly parallel plate flange (lower and upper back wall area) which continues above the joint point to a sufficient distance for minimizing bending and pulling tensions. The pitman may be made lighter as the known pitman by a honeycomb structure continuing above the joint point of the toggle plate. According to some embodiments, the openness of the cross-sectional profile of the pitman is changed in a strength-wise sufficient distance from the joint point between the toggle plate and the pitman. The desired loading level of the crusher/pitman and the life span as well as the fixing points of the wear parts define the dimensions of the pitman which further define the size of the distance. In some embodiments, the fixing point is taken from such a distance from the joint point in which point the height of the web is 80-90% of the maximum height of the web. The height of the web is measured as a perpendicular distance from the front surface of the lower part of the pitman to the outer curve of the web. Additionally, the lower part of the pitman is a firm honeycomb structure, to the connection areas of which strength-increasing roundings are made.

Various embodiments of the present invention are or have been illustrated with reference to one or some aspects of the invention. It is clear to person skilled in the art that any embodiment of an aspect of the invention may be applied in the same aspect and other aspects either by itself or in connection with various other embodiments.

SHORT DESCRIPTION OF THE DRAWINGS

Figure 2:
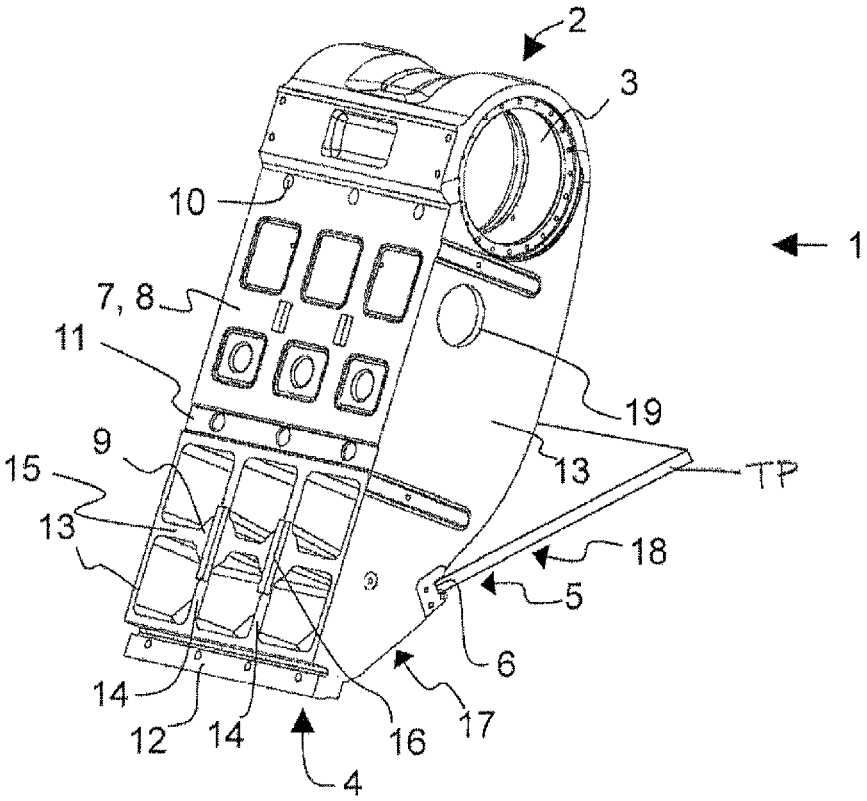
Figure 3:
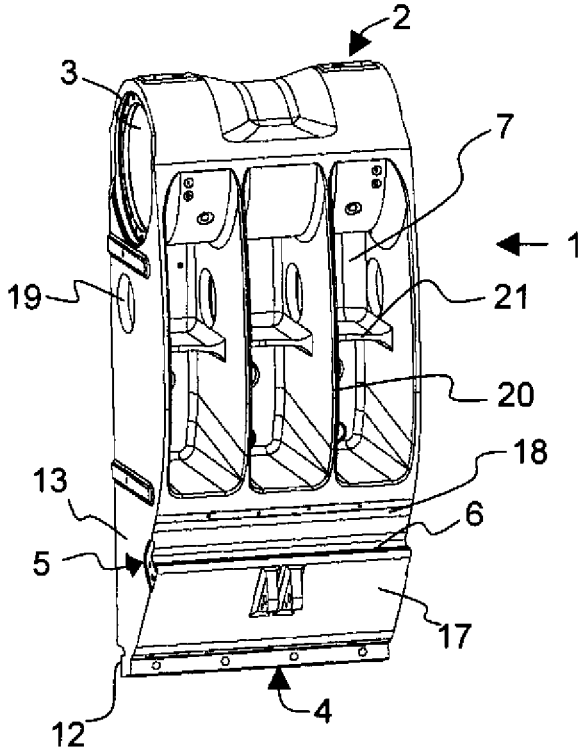
Figure 4:
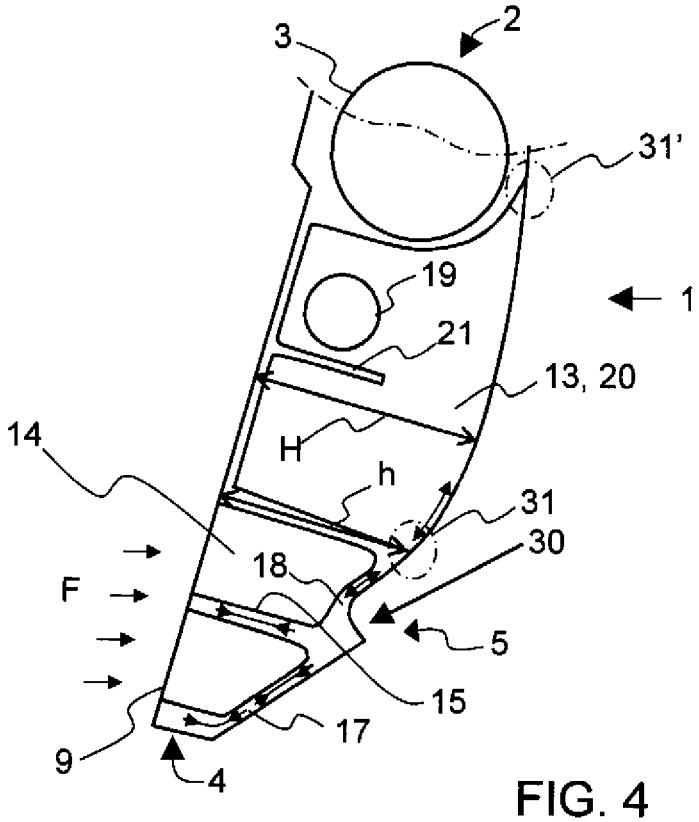
Figure 5:
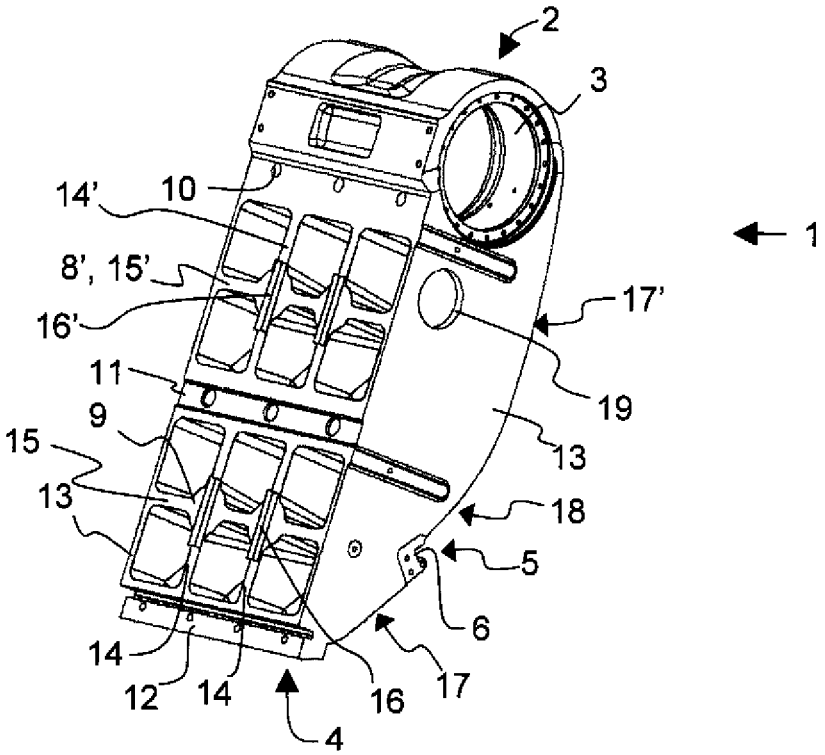
Figure 6:
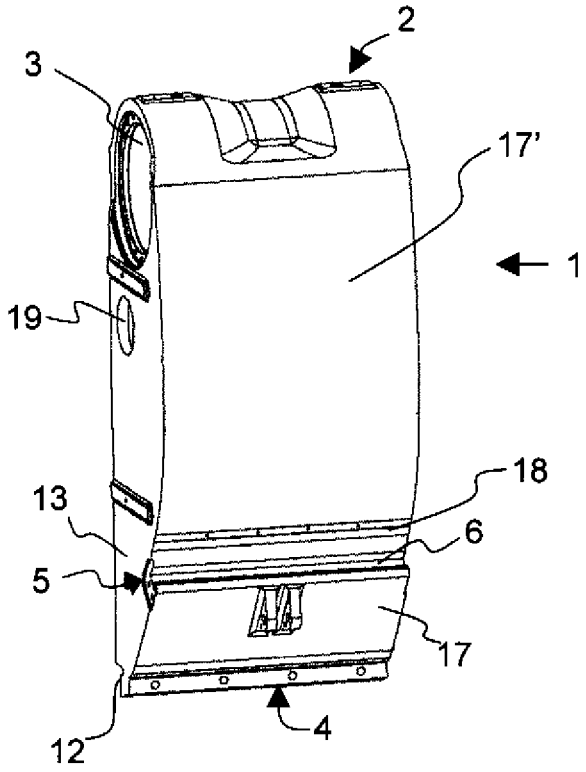

The invention will be described, by way of example only, with reference to the accompanying schematic drawings, in which:

FIG. 1 presents from side a crushing plant suitable for crushing mineral material;

FIGS. 2 and 3 present a first pitman of a jaw crusher, the cross-sectional profile of which is open backwards in the upper part of the pitman and, in the support area of the toggle plate, the pitman comprises a forwards open honeycomb structure;

FIG. 4 presents a cross section of the pitman presented in FIGS. 2 and 3; and FIGS. 5 and 6 present a second pitman of a jaw crusher, the cross-sectional profile of which is open forwards in the upper part of the pitman and in the area of the supporting point of the toggle plate, the pitman comprises a forwards open honeycomb structure.

DETAILED DESCRIPTION

In the following description like reference signs denote like parts. It should be realized that the presented figures are not in scale as a whole, and they serve merely to illustrate the embodiments of the invention.

In FIG. 1, there is presented a processing apparatus of mineral material, a crushing plant 200 comprising a jaw crusher 100. In the crushing plant 200, there is a feeder 103 for feeding material into the jaw crusher 100 and a belt conveyor 106 for transferring crushed material further from the crushing plant.

The belt conveyor 106 presented in FIG. 1 comprises a belt 107 arranged to proceed around at least one drum 108. The crushing plant 200 also comprises a power source and a control centre 105. The power source may be for instance a diesel or electric motor, which provides energy to be used by process units and hydraulic circuits.

The feeder 103, the crusher 100, the power source 105 and the conveyor 106 are attached to the body 101 of the crushing plant, which in this embodiment also comprises a track platform 102 for moving the crushing plant 200. The crushing plant may also be totally or partly wheel-based or movable by legs. Alternatively, it may be movable/towable for instance with help of a truck or some other exterior power source.

Mineral material may be for instance quarried stone or it may be asphalt or decommissioning waste such as concrete, or brick etc. In addition to the foregoing, the crushing plant may be a fixed crushing plant.

The embodiments of the pitman 1, 1' of the jaw crusher 100, presented with help of FIGS. 2-6, may be used for instance in the crushing station 200 in FIG. 1. The crushing station 200 and the jaw crusher 100 are configured to receive the pitman 1, 1', which can be lighter than the known pitmans, when an increase in strength caused by the stiffening of the pitman structure is taken into account. The power used by the crusher per the amount of crushed mineral material may be smaller than with known applications because in the crushing event, less energy is used in the transformation of the pitman. On the other hand, a greater crushing volume may be achieved with the same crushing power because a greater part of drive power may be focused in crushing mineral material.

In FIGS. 2, 3 and 4, there is presented a pitman 1 open in two directions, which is preferably manufactured by casting. The upper part 2 of the pitman comprises an upper supporting point 3 for supporting the pitman in the body of the jaw crusher through an eccentric shaft (not presented in figs.). The first supporting point 3 defines a hole which reaches from the side of the pitman to the other. The lower part 4 of the pitman comprises a lower supporting point 5 for supporting the pitman in the body of the jaw crusher through a toggle plate TP. There is arranged a supporting groove 6 in the lower supporting point 5. The force and direction of the toggle plate are presented in FIG. 4 by an arrow 30.

In an example, the wear part which is aimed to be fixed in front of the pitman is two-part (not presented in figs.) but one-part and multi-part wear parts may be used, as well. The upper wear part is fixed in the front surface 8 of the front wall 7 of the upper part of the pitman and the lower wear part is fixed in the front surface 9 of the lower part of the pitman below the upper wear part. The pitman 1 comprises first fixing means 10 in the upper part of the front surface 8 of the upper part for fixing wear parts, second fixing means 11 between the front surfaces of the upper and lower part and third fixing means 12 below the front surface of the lower part. Holes, among others, are arranged as fixing means for fixing wedges.

The support of the wearing plate to be fixed in the side of the crushing chamber in the pitman may be improved by the new structure of the pitman. A cross-sectional support 15 may be formed in the pitman in cross direction of the pitman (in the width direction of the crushing chamber), which is preferably horizontal, when areas supporting the wearing plate from back in cross direction may be formed in the pitman in addition to the vertical supports.

In FIGS. 2, 3 and 4, the cross-sectional profile of the pitman is open backwards in the upper part of the pitman and open forwards in the area of the supporting point 5 of the toggle plate TP. In the area of the supporting point 5 of the toggle plate TP, the lower part of the pitman comprises a honeycomb structure open forwards. The honeycomb structure vertically comprises sidewalls 13 and vertical supports 14 of the pitman, which vertically divide the space between the sidewalls in parts. The honeycomb structure additionally comprises one or more cross-sectional supports 15, which intersect with the vertical support/supports 14 and horizontally divide the profile of the lower part 4 in parts, which profile is open forwards (open in the crushing direction). There may be one or more vertical supports, in the examples in figures there are two vertical supports. The cross-sectional support 15 improves the sideward rigidity of the vertical supports when the support span of the supports diminishes. In the examples of the figures, the honeycomb structure comprises six compartments divided by two vertical supports and one cross-sectional support in the middle. A centering mechanism 16 of the wear part, such as a wedge, is attached in the intersections of the vertical supports and cross-sectional supports in the front surface 9 of the lower part 4.

In crushing, the sideward forces coming across to the pitman 1 from the wear part and the forces distorting the pitman are received in the object rigidity-wise better than the known one, the wear part stays better in position sideward and the transformation caused by the crushing process in the whole pitman and the vertical supports may be reduced. Thus the crushing energy is better focused in the crushing mineral material and the life span of the pitman increases.

Preferably, the sidewall 13, the vertical support 14 and the cross-sectional support 15 are ribs or walls commencing forward from the back wall areas 17 and 18 connecting the sidewalls 13 of the lower part of the pitman. The lower back wall area 17 is arranged behind the lower compartments of the honeycomb structure. The upper back wall area 18 is arranged behind the upper compartments of the honeycomb structure. The lower back wall area 17 continues uniformly onto the upper back wall area 18 in the area of the supporting point 5 of the toggle plate TP (in the area of the second supporting point of the jaw crusher). Preferably, both back wall areas 17, 18 are arranged parallel with the direction of the toggle plate TP. In that case, there are forces formed in the direction of the back walls in the back walls 17, 18, which has been illustrated with help of the arrows drawn in the cross-section of FIG. 4. In the presented structure, the back wall areas 17, 18 have been designed to receive compression and/or pulling and not bending. This increases the life span of the pitman and the wall thickness of the pitman may be reduced in the lower part.

Preferably, the foremost point of the sidewalls, vertical supports and horizontal supports forms a part of the front surface 9 of the lower part of the pitman for supporting the back surface of the wear part.

The pitman 1 may comprise a hole 19 for the intermediate rod in the upper part 2 but it is not necessary. FIG. 3 presents the pitman 1 from back, the upper part of which pitman comprises a backwards open structure where the area between the sidewalls 13 is divided in vertical compartments by vertical webs 20 fixed in the front wall 7. The vertical webs 20 are connected with each other with horizontal supports 21, the web height of which from the front wall is only a part of the height of the sidewalk and vertical webs.

In FIG. 4, the crushing power directed at the pitman is illustrated with the arrow F. The uniform hack wall area 17, 18 and the cross-sectional support 15 transfer the crushing force as steadily as possible to the toggle plate TP, which in a normal crushing event receives the most of the crushing force (does not receive everything because a part of it is divided to the bearing of the upper end). The lower back wall area 17 is a particularly important wall because when crushing fine material the crushing force increases considerably below. A typical angle for the direction 30 of the toggle plate TP is approximately 45 degrees regarding the front surface 9 of the pitman, and the range on various settings and in various movement positions (min-max) of the pitman is approximately 5-10 degrees.

The openness of the cross-sectional profile of the pitman 1 is changed in a strength-wise sufficient distance (circle and reference number 31) from the joint point (arrow and reference number 30) between the toggle plate TP and the pitman. The desired loading level and the life span as well as the fixing points of the wear parts define the dimensions of the pitman, which further define the size of the distance. In an embodiment, the fixing point is taken from such a distance from the joint point in which point the height h of the web 13, 20 is 80-90% of the maximum height H of the web 13, 20. The height of the web 13, 20 is measured as a perpendicular distance from the front surface 9 of the lower part of the pitman to the outer curve of the web 13, 20.

In the open profile of the pitman 1, the critical points of tensions are located in the free edges 31, 31' of the webs (walls 13) of the pitman. Because the lower free edge 31 is located within such a distance from the joint point where the height of the web is as great as possible, the tensions directed to the edge 31 may be achieved smaller.

The honeycomb structure reduces the support spans of the jaws (wear parts) and reduces vertical and cross-sectional bending transformations of the pitman and thus supports the wear parts even more than before. Because the energy being used is not spent in the bending transformations but in the crushing event itself the efficiency of crushing is improved.

FIGS. 5 and 6 present a second pitman 1' of a jaw crusher, the cross-sectional profile of which is open forwards in the upper part 2 of the pitman. In the area of the supporting point 5 of the toggle plate TP, the pitman 1' comprises a honeycomb structure open in the direction of the crushing chamber, which structure is presented in connection with FIGS. 2-4. The second pitman 1' is thus a pitman open in one direction. In the second pitman 1', the upper supporting point 3 of the ripper part 2, the lower part 4, the honeycomb structure of the lower part, the lower supporting point 5 and the hole 19 for the intermediate rod are similar with the first pitman 1. The second pitman need not necessarily have the hole for the intermediate rod.

In FIGS. 5 and 6, the upper part 2 of the pitman 1' comprises a honeycomb structure like the honeycomb structure of the lower part 4, which structure is open on the front surface 8' of the upper part of the pitman. The honeycomb structure vertically comprises the sidewalls 13 and vertical supports 14' of the pitman, which vertically divide the space between the sidewalls in parts. The honeycomb structure additionally comprises one or more cross-sectional supports 15', which intersect with the vertical support/supports 14' and horizontally divide the profile of the upper part 2, which profile is open forwards (open in the crushing direction). There may be one or more vertical supports, in the examples in figures there are two vertical supports. The cross-sectional support 15' improves the sideward rigidity of the vertical supports. In the examples of the figures, the honeycomb structure comprises six compartments which are divided by two vertical supports and one cross-sectional support in the middle. A centering mechanism 16' of the wear part, for example a wedge, is attached in the intersections of the vertical supports and cross-sectional supports. In the upper part, the sidewall 13, the vertical supports 14' and the cross-sectional support 15' are ribs or walls commencing forward from the back wall 17' of the upper part of the pitman.

The pitman 1, 1' may be manufactured, instead of casting or additionally, by welding or by a corresponding method, where an object is attached to another object by using at least partial melting of the material of the object, using additive or without additive.

The foregoing description has provided non-limiting examples of some embodiments of the invention. It is however clear to a person skilled in the art that the invention is not restricted to details of the embodiments presented above, but that it can be implemented using equivalent means.

Furthermore, some of the features of the above-disclosed embodiments may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A pitman of a jaw crusher, the pitman comprising an upper part, which comprises an upper supporting point for supporting the pitman in the body of the jaw crusher, and a lower part, comprising a lower supporting point for supporting the pitman in the body of the jaw crusher through a toggle plate, wherein the lower part of the pitman comprises first and second sidewalls extending from a front surface to a rear edge, and a forwards open honeycomb structure open in a crushing direction, which forwards open honeycomb: structure comprises one or more cross-sectional supports reaching from the first sidewall of the pitman to the second sidewall, and a back wall area opposite the front surface, and wherein the upper part of the pitman comprises a backwards open structure located above the back wall area and open in a direction opposite the crushing direction.

2. The pitman according to claim 1, wherein the lower supporting point of the pitman is arranged in a location of the cross-sectional support of the forwards open honeycomb structure.

3. The pitman according to claim 2, wherein the sidewalls of the pitman form the sidewalls of the forwards open honeycomb structure and the forwards open honeycomb structure comprises one or more vertical supports intersecting with the cross-sectional support/supports, for dividing the space between the sidewalls of the pitman vertically in parts.

4. The pitman according to claim 3, wherein the back wall area is attached to the sidewalls, the vertical supports and the cross-sectional supports.

5. The pitman according to claim 2, wherein the front surface of the lower part comprises front edges of the sidewalls, and the cross-sectional supports, adapted for receiving a wear part.

6. The pitman according to claim 1, wherein the sidewalls of the pitman form sidewalls of the forwards open honeycomb structure; and the forwards open honeycomb structure comprises one or more vertical supports intersecting with the cross-sectional support/supports, for dividing the space between the sidewalls of the pitman vertically in parts.

7. The pitman according to claim 6, wherein the back wall area is attached to the sidewalls, the vertical supports and the cross-sectional supports.

8. The pitman according to claim 7, wherein the back wall area comprises a lower back wall area and an upper back wall area, which join in the location of the cross-sectional support and the back wall areas are arranged parallel such that a force directed in the pitman by the toggle plate in a crushing event is substantially parallel with the direction of the back wall areas.

9. The pitman according to claim 7, wherein the front surface of the lower part comprises front edges of the sidewalls, the vertical supports and cross-sectional supports, adapted for receiving a wear part.

10. The pitman according to claim 6, wherein the front surface of the lower part comprises front edges of the sidewalls, the vertical supports and the cross-sectional supports, adapted for receiving a wear part.

11. The pitman according to claim 6, wherein a centering mechanism adapted for a wear part is attached in intersections of the vertical supports and the cross-sectional supports in the front surface of the lower part.

12. A jaw crusher for crushing mineral material comprising a pitman Which comprises an upper part comprising an upper supporting point for supporting the pitman in the body of the jaw crusher, and which pitman comprises a lower part comprising a lower supporting point for supporting the pitman in the body of the jaw crusher through a toggle plate, wherein the lower part of the pitman comprises first and second sidewalls extending from a front surface to a rear edge, and a forwards open honeycomb structure open in a crushing direction, which forwards open honeycomb structure comprises one or more cross-sectional supports reaching from the first sidewall of the pitman to the second sidewall, and a back wall area opposite the front surface, and wherein the upper part of the pitman comprises a backwards open structure located above the back wall area and open in a direction opposite the crushing direction.

13. A crushing plant comprising a jaw crusher with a pitman which comprises an upper part comprising an upper supporting point for supporting the pitman in the body of the jaw crusher, and which pitman comprises a lower part comprising a lower supporting point for supporting the pitman in the body of the jaw crusher through a toggle plate, wherein the lower part of the pitman comprises first and second sidewalls extending from a front surface to a rear edge, and a forwards open honeycomb structure open in the crushing direction, which forwards open honeycomb structure comprises one or more cross-sectional supports reaching from the first sidewall of the pitman to the second sidewall, and a back wall area opposite the front surface, and wherein the upper part of the pitman comprises a backwards open structure located above the back wall area and open in a direction opposite the crushing direction.

14. An apparatus for crushing mineral material in a jaw crusher or a crushing plant which jaw crusher or crushing plant comprises a crushing chamber, the apparatus comprising:

a pitman arranged in the crushing chamber, the pitman comprising an upper part having an upper supporting point for supporting the pitman in a body of the jaw crusher, and a lower part having a lower supporting point for supporting the pitman in the body of the jaw crusher through a toggle plate, the lower part of the pitman having first and second sidewalls extending from a front surface to a rear edge, and a forwards open honeycomb structure open in a crushing direction which forwards open structure has one or more cross sectional supports reaching from the first sidewall to the second sidewall, and a back wall area opposite the front surface, the upper part of the pitman having a backwards open honeycomb structure located above the back wall area and open in a direction opposite the crushing direction, wherein a change in the openness of cross sectional profile of the pitman occurs where a linear distance taken along the sidewalls from the front surface to the rear edge is 80%-90% of a maximum linear distance taken along the sidewalls from the front surface to the rear edge.

15. The apparatus according to claim 14, wherein the toggle plate comprised by the jaw crusher is supported in the lower supporting point of the pitman, which supporting point is arranged in a location of the cross-sectional support of the forwards open honeycomb structure.

16. The apparatus according to claim 14, wherein the toggle plate is located at the lower supporting point to permitting a toggle force to be conveyed through the cross sectional support.

17. The pitman of claim 1, wherein a Change in the openness of a cross sectional profile of the pitman occurs where a linear distance taken along the sidewalls from the front surface to the rear edge is 80%-90% of a maximum distance taken along the sidewalls from the front surface to the rear edge.

* * * * *